US007857304B2

(12) United States Patent
Koizumi et al.

(10) Patent No.: US 7,857,304 B2
(45) Date of Patent: Dec. 28, 2010

(54) IMAGE FORMING APPARATUS

(75) Inventors: Takuma Koizumi, Toride (JP); Daijiro Kato, Abiko (JP); Kiyoshi Oyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 12/410,919

(22) Filed: Mar. 25, 2009

(65) Prior Publication Data

US 2009/0256304 A1 Oct. 15, 2009

(30) Foreign Application Priority Data

Apr. 14, 2008 (JP) ..... 2008-104591

(51) Int. Cl.
*B65H 3/52* (2006.01)
*B65H 1/08* (2006.01)
*B65H 1/18* (2006.01)

(52) U.S. Cl. ..... 271/124; 271/126; 271/152; 271/154; 271/155

(58) Field of Classification Search ..... 271/124, 271/125, 126, 152, 154, 155
See application file for complete search history.

(56) References Cited

U.S. PATENT DOCUMENTS

| | | | | |
|---|---|---|---|---|
| 5,537,193 | A | 7/1996 | Hasegawa et al. | 355/271 |
| 6,581,925 | B1 * | 6/2003 | Shea et al. | 271/125 |
| 7,334,788 | B2 * | 2/2008 | Sakamaki et al. | 271/125 |
| 7,392,980 | B2 * | 7/2008 | Takeuchi et al. | 271/125 |
| 7,481,421 | B2 * | 1/2009 | Tsukamoto et al. | 271/110 |
| 2004/0061280 | A1 * | 4/2004 | Sciurba et al. | 271/152 |
| 2007/0096387 | A1 * | 5/2007 | Sciurba et al. | 271/152 |

FOREIGN PATENT DOCUMENTS

| | | |
|---|---|---|
| JP | 5-32356 | 2/1993 |

* cited by examiner

*Primary Examiner*—David H Bollinger
(74) *Attorney, Agent, or Firm*—Fitzpatrick, Cella, Harper & Scinto

(57) ABSTRACT

An image forming apparatus including a sheet bundle boundary detecting unit which detects a boundary of sheet bundles added to a sheet storage case, and a control unit which controls a feeding condition of sheet feeding unit based on a detection result of the sheet bundle boundary detecting unit. With this, overlapping-feeding and misfeeding at the boundary between the sheet bundles are reliably prevented.

6 Claims, 10 Drawing Sheets

WHEN SHEETS ARE ADDED

WHEN SHEET IS FED

WHEN SHEETS ARE ADDED

WHEN SHEET IS FED

IMAGE FORMING APPARATUS

BACKGROUND OF THE INVENTION

This application claims the benefit of Japanese Patent Application No. 2008-104591, filed Apr. 14, 2008, which is hereby incorporated by reference herein in its entirety.

1. Field of the Invention

The present invention relates to an image forming apparatus such as a copying machine and a printer having a sheet feeding apparatus which feeds a sheet.

2. Description of the Related Art

A conventional image forming apparatus is provided with a sheet feeding apparatus which feeds a sheet to an image forming portion. Especially in a commercial-use mass-printing image forming apparatus, since a sheet feeding operation to the image forming portion largely influences the productivity (the number of sheets to be printed per unit time), it is extremely important to stably and reliably feed sheets by the sheet feeding apparatus.

In separating mechanisms in the sheet feeding apparatuses which enhance the productivity and reliably feed sheets, retard separating systems are widely used. The retard separating system feeds stacked sheets by a pickup roller, separates the sheets individually and conveys a sheet between a feed roller which rotates in the same direction as a sheet feeding direction and a retard roller which can rotate in a direction opposite from the sheet feeding direction.

In the retard separating system, the retard roller receives a torque in a direction opposite from the sheet feeding direction through a torque limiter, and when one sheet is fed by the pickup roller, a driving force is cut by the torque limiter and the retard roller rotates so as to follow the sheet.

When two or more sheets are fed, since a friction coefficient between the sheets is smaller than a friction coefficient between the feed roller and the sheets, the retard roller rotates in the opposite direction from the sheet feeding direction to return the second and subsequent sheets.

The friction coefficients of a sheet and the roller are changed depending upon the water content of the sheet to be fed and presence or absence of extraneous matter on a surface of the sheet. Because of this, overlapping-feeding in which sheets are not separated from each other and two or more sheets are superposed and fed, or misfeeding (feeding failure), in which a sheet is not fed by the separating mechanism, may be generated in some cases.

When a new sheet bundle is added to a sheet bundle which is stored in a cassette, this overlapping-feeding is especially prone to being generated due to extraneous matter or a difference in water content of sheets around the boundary between the previously stored sheet bundle and the newly added sheet bundle.

Further, sheets having high smoothness, such as art paper or coated paper used for color printing, are crushed near a boundary between sheet bundles and it becomes difficult for air to enter between the sheets. As a result, adsorption force between the sheets is increased, and the overlapping-feeding is prone to being generated near the boundary between the sheet bundles. If the overlapping-feeding or misfeeding of sheets is generated, it is necessary to stop the image forming apparatus to take out the overlapping-fed sheet or misfed sheet, and the productivity is deteriorated correspondingly.

It is proposed to automatically change a nip pressure of a separating mechanism comprising a feed roller and a retard roller and an abutment pressure of a pickup roller on sheets when the overlapping-feeding or misfeeding of sheets is generated. This technique is disclosed in Japanese Patent Application Laid-open No. 05-32356.

In this proposal, when the overlapping-feeding of a sheet is detected by an overlapping-feeding detection sensor, a nip pressure of the separating mechanism is increased to enhance the separating degree. Further, when a sheet is not sent to a predetermined position within a given time, it is determined that misfeeding of sheets is generated, and, therefore, a sheet abutment pressure of the pickup roller is increased and the conveying force of a sheet is enhanced. With this, the overlapping-feeding or misfeeding of a sheet is prevented.

In the conventional image forming apparatus, however, when sheets are overlapping-fed, the conveying operation of sheets is stopped, and the overlapping-fed sheet must be removed from the image forming apparatus. Therefore, even if the nip pressure of the separating mechanism is adjusted to solve the overlapping-feeding of the next sheet, although it is possible to prevent the overlapping-feeding from being generated, the already generated overlapping-fed sheet cannot be solved.

That is, in the conventional proposal, when a roller is worn with time or when special sheets having friction coefficient different from that of plain paper are continuously fed and the overlapping-feeding is frequently generated, the nip pressure is adjusted to stabilize the feeding operation of sheets. Therefore, this proposal is not suitable for overlapping-feeding caused due to change in temporary surface states of sheets.

That is, a problem such as the overlapping-feeding of sheets prone to be generated in a boundary between sheet bundles cannot be solved, and it is, therefore, difficult to maintain high productivity.

SUMMARY OF THE INVENTION

In view of the above circumstances, it is an object of the invention to provide an image forming apparatus capable of reliably prevent the overlapping-feeding and a misfeeding of sheets, and maintaining productivity.

According to a typical structure of the present invention, the above object can be achieved by an image forming apparatus which forms an image on a sheet by an image forming unit comprising: a sheet storage portion in which sheets are stored; a sheet feeding unit which feeds the sheet stored in the sheet storage portion; a sheet bundle boundary detecting unit which detects boundaries between sheet bundles added in the sheet storage portion; and a control unit which determines the boundary of the sheet bundle based on a detection result of the sheet bundle boundary detecting unit and which changes a feeding condition of the sheet feeding unit.

According to the present invention, since the feeding condition of the sheet feeding unit is changed based on a detection result obtained by the sheet bundle boundary detecting unit, it is possible to reliably prevent the overlapping-feeding and misfeeding at the sheet bundle boundary, and to maintain the productivity of the image forming apparatus.

Further features of the present invention will become apparent from the following description of exemplary embodiments (with reference to the attached drawings).

DESCRIPTION OF THE EMBODIMENTS

Embodiments of the present invention will be described in detail based on the drawings.

Embodiment 1

Figure 1:
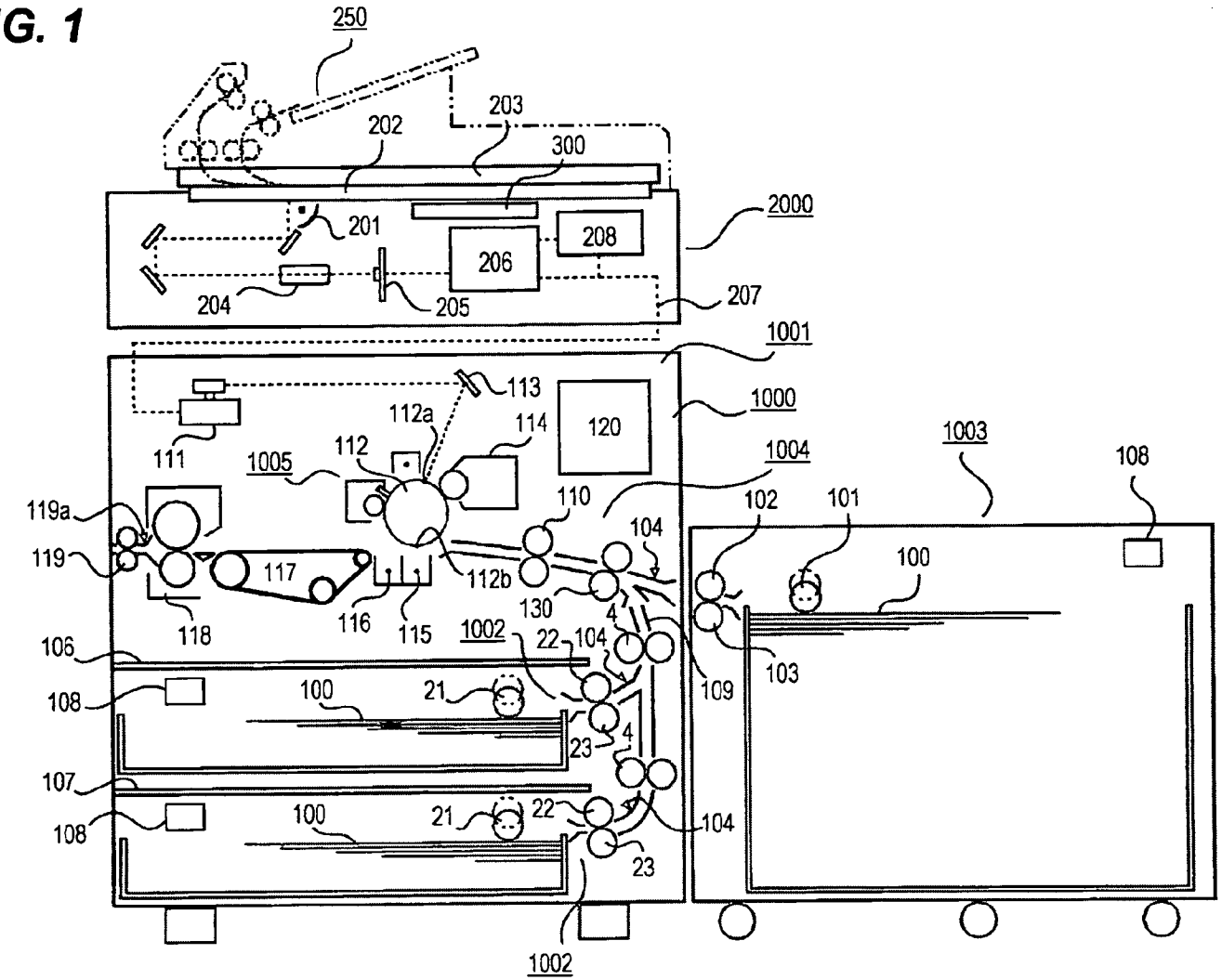
FIG. 1 is a vertical sectional view of an image forming apparatus according to a first embodiment of the present invention.
Figure 2:
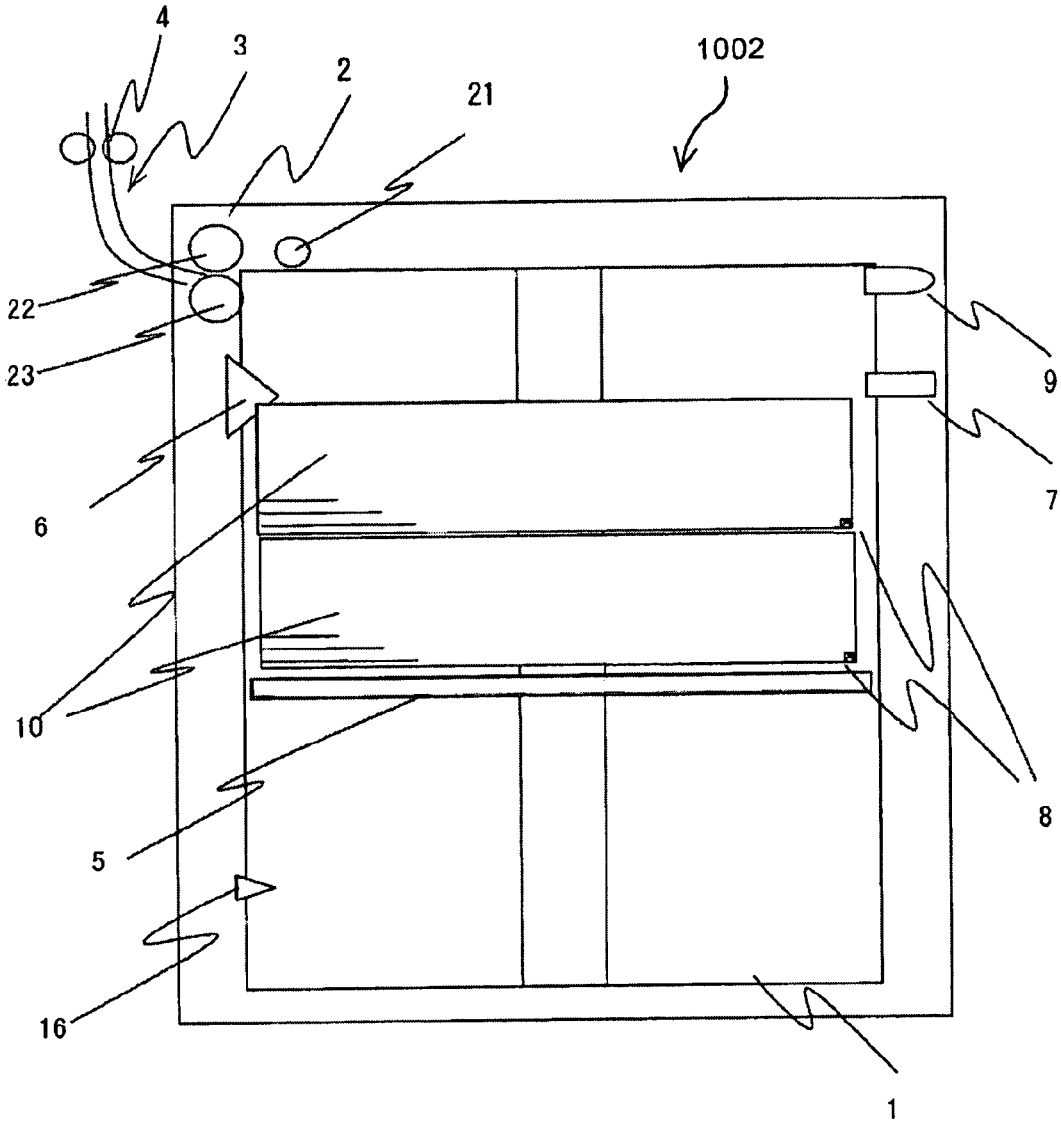
FIG. 2 is a schematic diagram illustrating a structure of a sheet feeding apparatus illustrated in FIG. 1.
Figure 3:
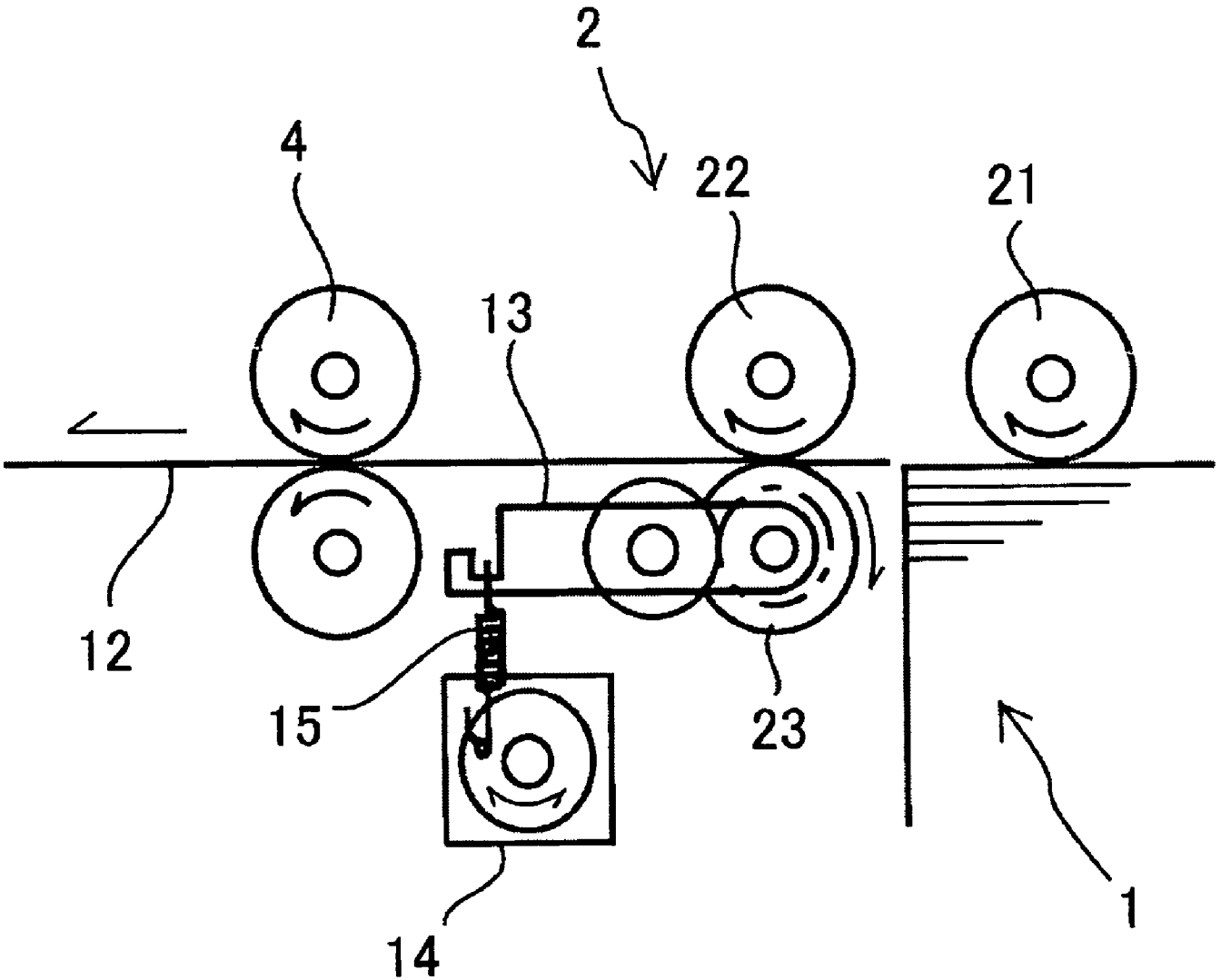
FIG. 3 is a diagram illustrating a structure of sheet feeding unit illustrated in FIG. 2.

FIG. 1 is a vertical sectional view illustrating the entire structure of an image forming apparatus according to a first embodiment of the present invention. FIG. 2 is a schematic diagram illustrating a structure of the sheet feeding apparatus illustrated in FIG. 1. FIG. 3 is a diagram illustrating a structure of the sheet feeding unit illustrated in FIG. 2.

A printer 1000 illustrated in FIG. 1 includes a printer body 1001 and a scanner 2000 disposed on an upper surface of the printer body 1001.

The scanner 2000 reads an image on an original The scanner 2000 includes a scanning optical light source 201, a platen glass 202 and an opening/closing original pressure plate 203. The scanner 2000 further includes a lens 204, a light receiving element 205 (photoelectric conversion), an image processing portion 206, and a memory 208 which stores an image processing signal processed by the image processing portion 206.

When an original is to be read, the original (not illustrated) placed on the platen glass 202 is irradiated with light by the scanning optical light source 201 to read the original. A read original image is processed by the image processing portion 206, the image is then converted into an electrically encoded electric signal 207, and is sent to a laser scanner 111 as an example of an image forming unit.

Image information which is processed by the image processing portion 206 and encoded can once be stored in the memory 208, and can also be sent to the laser scanner 111 by a signal from a controller 120 as required.

The printer body 1001 includes a sheet feeding apparatus 1002 which feeds a sheet, and a sheet conveying apparatus 1004 which conveys the sheet fed by the sheet feeding apparatus 1002 to an image forming portion 1005. The printer body 1001 further includes the controller 120 which is the control unit to control the printer 1000.

There is also a large-capacity paper deck 1003 which is an optional detachable sheet feeding apparatus (since the essential structure of the paper deck 1003 is symmetric to the sheet feeding apparatus 1002 and its mechanism and function are the same as those of the sheet feeding apparatus 1002, detailed description of the paper deck 1003 will be omitted).

The sheet feeding apparatus 1002 includes a separating portion. The separating portion includes cassettes 100 as an example of stacking unit, a pickup roller 21 as an example of sheet feeding unit, a feed roller 22 and a retard roller 23. Sheets in the cassette 100 are separated one sheet at a time and are fed by the pickup roller 21 which is lifted, lowered/rotated at a predetermined timing of the separating portion.

A feeding sensor 104 is provided near the downstream area of the feed roller 22 and the retard roller 23 in the sheet conveying direction so that it is possible to detect that a sheet passes.

Each cassette 100 is divided by dividing plates 106 and 107, and is hermetically closed at a predetermined hermetical degree. A temperature/moisture sensor 108 is disposed in each hermetic space to detect temperature and moisture in the space, and it is possible to independently detect the temperature and moisture in each space. A structure of the feeding portion will be described in detail later.

The sheet conveying apparatus 1004 includes a pair of conveying rollers 4, and a registration roller portion having a pair of pre-registration rollers 130 and a pair of registration rollers 110. Sheets fed from the sheet feeding apparatus 1002 pass through a sheet conveying path 109 constituted by a guide plate near the pair of conveying rollers 4. Thereafter, the sheets are guided by the guide plate and led to the pair of registration rollers 110. Once the sheet hits the pair of registration rollers 110, the skew feeding generated when the sheet is fed and conveyed is corrected, and the sheet is then conveyed to the image forming portion 1005.

The image forming portion 1005 includes a photosensitive drum 112, a laser scanner 111, a development device 114, a transfer charger 115 and a separation charger 116. When an image is to be formed, laser light from the laser scanner 111 is reflected by a mirror 113. An exposure position 112*a* on the photosensitive drum 112 rotating in the clockwise direction in FIG. 1 is irradiated with the light, and a latent image is formed on the photosensitive drum 112. Further, the latent image formed on the photosensitive drum 112 is visualized as a toner image by the development device 114.

Figure 6:
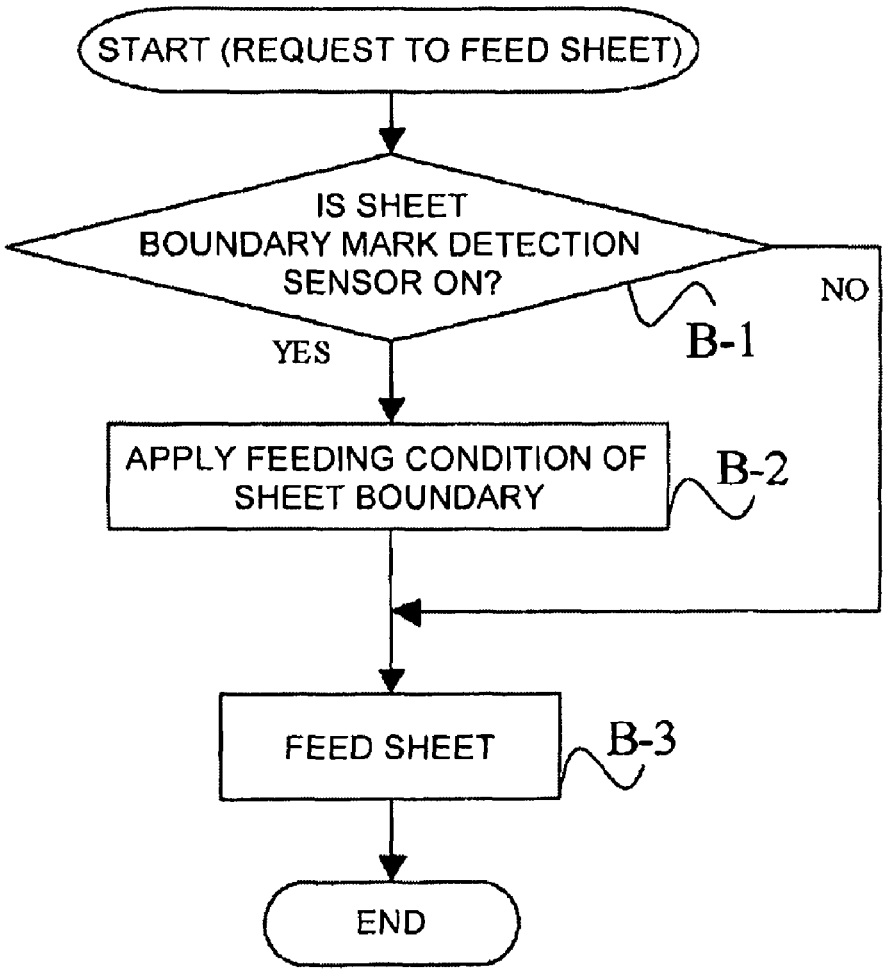
FIG. 6 is a flowchart for describing operation of the sheet feeding apparatus illustrated in FIG. 2 when sheets are fed.

The laser scanner 111 is driven by a laser writing position control circuit 111*a* by a control signal from the controller 120 (see FIG. 6). It is possible to adjust the irradiation position of the laser light, and a latent image writing position in the longitudinal direction on the photosensitive drum 112, i.e., the so-called main scanning direction can be changed.

A toner image on the photosensitive drum 112 is then transferred to a sheet by the transfer charger 115 in a transfer portion 112*b*. The sheet to which the toner image is transferred is electrostatically separated from the photosensitive drum 112 by the separation charger 116. Then, the sheet is conveyed to the fixing apparatus 118 by the conveying belt 117, the toner image is fixed and the sheet is discharged by the discharge roller 119. A discharge sensor 119*a* is provided in a conveying path between the fixing apparatus 118 and the discharge roller 119 so that passage of the sheet can be detected.

Although the printer body 1001 and the scanner 2000 are separated elements in this embodiment, the printer body 1001 and the scanner 2000 may be integrally formed as one unit. Whether the printer body 1001 and the scanner 2000 are the separated elements or integrally formed as one unit, if a processing signal of the scanner 2000 is input to the laser scanner 111, they function as a copying machine, and if a FAX sending signal is input, they function as a facsimile machine. If an output signal of a personal computer is input, they function as a printer, and if a processing signal of the image processing portion 206 of the scanner 2000 is sent to another facsimile machine, they function as a facsimile machine.

Additionally, if an automatic original feeding apparatus 250, as illustrated with phantom lines, is attached to the scanner 2000 instead of the pressure plate 203, it is also possible to automatically read an original.

The sheet feeding apparatus 1002 illustrated in FIG. 2 feeds sheets to the image forming portion of the image forming apparatus, such as a laser printer, a copying machine, and a facsimile machine. That is, the sheet feeding apparatus 1002 sends out sheets stored in the sheet storage case (sheet storage portion) 1 by the pickup roller 21 of sheet feeding unit 2. The feed roller 22 and the retard roller 23 constituting the sheet separating mechanism separates sheets from one another, and the pair of conveying rollers 4 provided in the sheet conveying path 3 feeds the sheet toward the image forming portion.

When sheets are added to the sheet storage case 1, the sheet storage case 1 is pulled out from the apparatus, and a bottom surface of a sheet bundle 10 to be added is placed on the uppermost sheet of the already stored sheet bundle.

If the position of the uppermost sheet of the already stored sheet bundle is lower than a ceiling surface of the sheet storage case 1 by about 50 to 100 mm, it is easy to stored the sheet bundle 10.

Therefore, the sheet feeding apparatus includes a vertically movable stack tray 5 and a sheet height position detection sensor 6, and the sheet feeding apparatus is lowered by about 50 to 100 mm. As a sheet bundle 10 is normally distributed in a form of a package, and one package is about 50 mm, the stack tray 5 is, therefore, lowered by height of one or two packages.

The sheet height position detection sensor 6 includes a later-described photo-interrupter 35 and a detection lever which is disposed such that it can abut against an end surface of a sheet. If the detection lever abuts against a vertically moving sheet or separates from the sheet and the detection lever moves to block the light from the photo-interrupter 35, an ON/OFF signal is output from the photo-interrupter 35.

If the sheet storage case 1 is opened to add sheets, the stack tray 5 is lowered by a motor (not illustrated). If the uppermost sheet of the sheet bundle 10, which is already stored, is lowered to the position of the detection lever of the sheet height position detection sensor 6, the stack tray 5 stops.

If the sheet is lowered and the detection lever of the sheet height position detection sensor 6 is released from a state where the detection lever is pushed by the sheet and the detection lever moves, an OFF signal is output from the photo-interrupter 35, and the stack tray 5 is stopped based on this output signal.

A user adds a sheet bundle 10 in the state where the stack tray 5 exists in the lowered position, and it is determined that a new sheet bundle 10 is added based on a detection signal from the sheet height position detection sensor 6.

That is, if a sheet bundle 10 is added, the detection lever is pushed by the added sheets, an ON signal is output by the photo-interrupter 35, and it is detected that the new sheet bundle 10 is added. If the photo-interrupter 35 outputs the ON signal, it is determined that the sheet bundle 10 is added, and sheet bundle side surface marking unit 7 forms a mark 8 on the sheet bundle boundary.

A position of the upper surface of the sheet bundle 10 which is already stored and a position of a bottom surface of the added sheet bundle 10 are kept constant by the lifter structure. Therefore, if the sheet bundle side surface marking unit 7 is disposed at the height position, the mark 8 is put on the boundary between the sheet bundles 10. That is, if the sheet bundle side surface marking unit 7 is disposed at the same height position as that of the sheet height position detection sensor 6, the mark 8 can be put on the boundary between the sheet bundles 10.

Next, after the mark 8 is put on the sheet bundle 10, the stack tray 5 starts lowering based on the ON signal from the photo-interrupter 35 of the sheet height position detection sensor 6 If the photo-interrupter 35 of the sheet height position detection sensor 6 again outputs an OFF signal and the uppermost sheet position of the sheet bundle 10 is detected, the stack tray 5 stops.

By repeating this operation, whenever the sheet bundle 10 stacked on the stack tray 5 is added, the mark 8 is sequentially put on the boundary between the previously added sheet bundle 10 and the newly added sheet bundle 10.

As the sheet bundle side surface marking unit 7, a stamp is used for example. Since the side surfaces of the sheet bundle 10 are not uniformly aligned in many cases, a material which is deformed in accordance with a shape of the side surface of the sheet bundle 10, such as sponge, is used as a marking surface of the stamp.

Even if the color of the mark 8 put on the side surface of the sheet bundle 10 is black, it is inconspicuous if the sheets are separated one sheet by one sheet, but paint of color which can not easily recognized by human eyes such as light yellow or paint including fluorescent material together with black light is used, the mark 8 can be even more inconspicuous.

A mark detection sensor 9 detects the mark 8 put on the boundary between sheets. An image pickup element is used as the mark detection sensor 9. A side surface of the sheet bundle is irradiated with light by a light source, and the side surface is shot as a subject. The mark 8 is detected by a difference in the reflection coefficients between the paint applied as the mark 8 on the boundary between sheets and a side surface of the sheet bundle 10 on which paint is not applied.

To detect whether the mark 8 is put on the sheet immediately before the sheet is fed by the sheet feeding unit 2, the height position of the mark detection sensor 9 is equal to or slightly lower than the sheet feeding unit 2.

When the sheets are sequentially fed and a sheet corresponding to the boundary between the sheet bundles is fed, feeding conditions of the sheet feeding unit 2 are changed according to the detection information of the mark detection sensor 9. Examples of the feeding conditions to be changed are a conveying speed of the feed roller 22 and a pressing force of the retard roller 23.

When the conveying speed of the feed roller 22 is changed, if the conveying speed is reduced, the overlapping-feeding at the sheet bundle boundary can be prevented. Although the productivity of the image forming apparatus is deteriorated while the conveying speed of the sheets is reduced, large deterioration can be suppressed as compared with productivity reduction caused by stopping the apparatus as when overlapping-feeding of sheets is generated. The conveying speed of the feed roller 22 is changed by changing the number of revolutions of the feed roller 22, i.e., by changing the number of revolutions of the motor which drives the feed roller 22.

When the pressing force of the retard roller 23 is to be changed, a nip pressure pressing the retard roller 23 of the sheet separating mechanism to the feed roller 22 is increased. A mechanism which changes the conveying conditions of sheets by the pressing force of the retard roller 23 will be described using FIG. 3.

In the sheet separating mechanism, the retard roller 23 is connected to driving unit such as a motor through a torque limiter mechanism (not illustrated) By driving the retard roller 23 in the direction opposite from the sheet conveying direction, sheets 12 are sent out by the pickup roller 21, and they are separated one sheet by one sheet between the pickup roller 21 and the feed roller 22. That is, when one sheet 12 is fed by the pickup roller 21, the driving force is cut by the torque limiter, and the retard roller 23 rotates to follow the sheet 12.

When two or more sheets 12 are fed, a friction coefficient between the sheets is smaller than a friction coefficient between the feed roller 22 and the sheet 12. Thus, the retard roller 23 rotates in the direction opposite from the sheet feeding direction, the sheets 12 are separated from each other and the second and subsequent sheets 12 are returned.

When the nip pressure between the feed roller 22 and the retard roller 23 is changed, a motor 14 is connected to an end of an arm member 13 which rockably supports the retard roller 23 through a spring 15.

With this structure, the arm member rocks through the spring 15 by rotation of the motor 14, and the retard roller 23 comes into contact with the feed roller 22 under pressure by the resilience force of the spring 15. Therefore, the expansion and contraction length of the spring 15 is changed by rotation angle of the motor 14, thereby adjusting the force of the retard roller 23 which comes into contact with the feed roller 22 under pressure.

If the pressing force of the retard roller 23 with respect to the feed roller 22 is increased, the overlapping-feeding is reduced but the misfeeding appears more frequent. If the pressing force is reduced, the reverse problem occurs. Thus, it is necessary to separate the stacked sheets 12 with optimal pressing force at the sheet 12 of boundary between the sheet bundles 10 and a place other than this place. This will be described later in detail.

Figure 4:
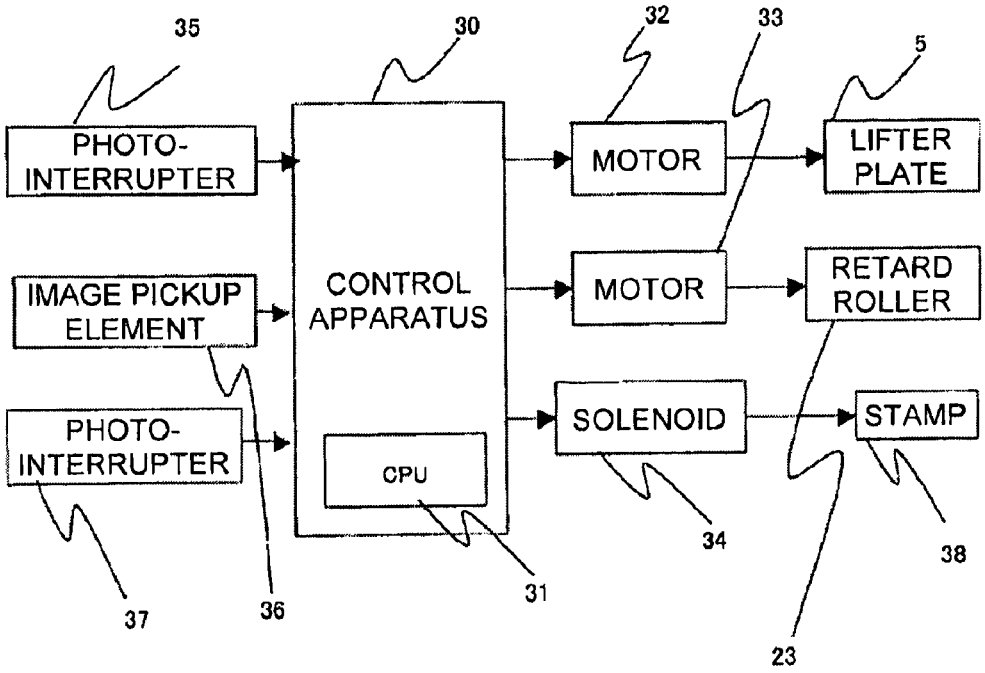
FIG. 4 is a block diagram for describing control of the sheet feeding apparatus illustrated in FIG. 2.

FIG. 4 is a control block diagram of this embodiment. In FIG. 4, a control apparatus 30 includes a CPU 31 which detects a boundary between sheet bundles 10 added to the sheet storage case 1, and adjusts the change of feeding conditions of the sheet feeding unit 2 based on the detection result.

Photo-interrupters 35 and 37 and an image pickup element 36 are connected to the control apparatus 30 such that detection information is input from the photo-interrupters 35 and 37 and the image pickup element 36. The photo-interrupter 35 constitutes the sheet height position detection sensor 6, the image pickup element 36 constitutes the mark detection sensor 9, and the photo-interrupter 37 constitutes a sheet storage case full-load detection sensor 16. Motors 32 and 33 and a solenoid 34 are connected to the control apparatus 30 such as to control the motors 32 and 33 and the solenoid 34.

The CPU 31 controls the motor 32 to move the stack tray 5 based on a detection signal from the sheet height position detection sensor 6. The CPU 31 controls the motor 33, rocks the arm member 13, moves the retard roller 23, and changes a pressing force with respect to the feed roller 22.

The image forming apparatus includes a stamp 38 constituting the sheet bundle side surface marking unit 7 which marks a side surface of the added sheet bundle 10. The stack tray solenoid 34 moves the stamp 38 and marks a side surface of the added sheet bundle 10. The solenoid 34 is controlled by the CPU 31 based on a detection signal from the sheet height position detection sensor 6 and moves the stamp 38.

Figure 5:
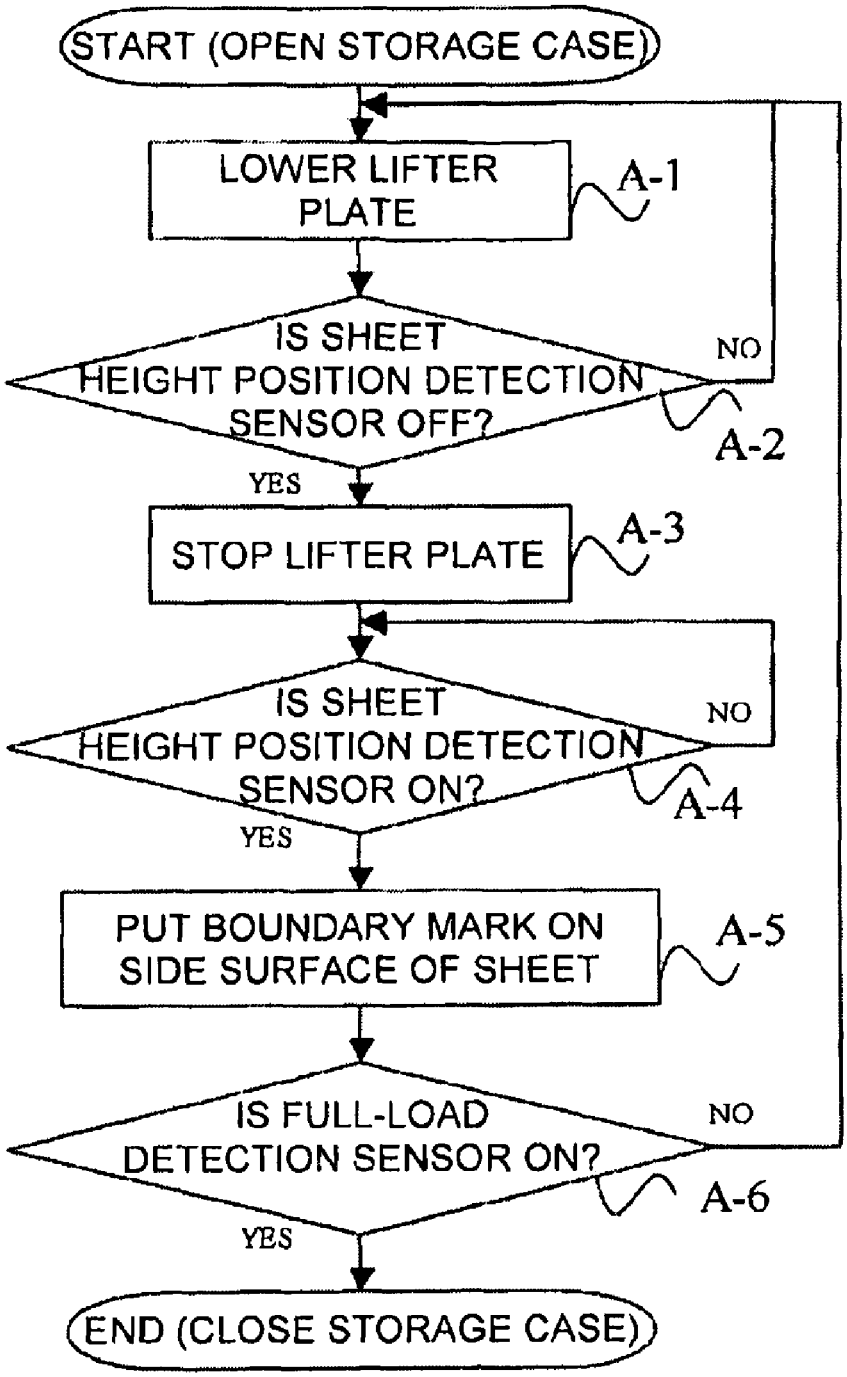
FIG. 5 is a flowchart for describing operation of the sheet feeding apparatus illustrated in FIG. 2 when sheets are added.

Control of the control apparatus 30 will be described using flowcharts illustrated in FIGS. 5 and 6. The description is divided into a case when sheets are added and a case when sheets are fed.

<When Sheets are Added>

If an operator pulls out the sheet storage case 1, a detection unit (not illustrated) detects that the sheet storage case 1 is pulled out, and the CPU 31 controls the motor 32 to start lowering the stack tray 5 (A-1). If the sheet height position is moved to a predetermined position which is set lower than the ceiling surface of the sheet storage case 1 by about 50 to 100 mm, the photo-interrupter 35 of the sheet height position detection sensor 6 is turned OFF (A-2).

The CPU 31 controls the motor 32 based on a signal from the photo-interrupter 35, stops the stack tray 5 and waits until a new sheet bundle 10 is added by an operator (A-3).

If the new sheet bundle 10 is added by the operator, since the height position of the sheet 12 is lifted, the photo-interrupter 35 of the sheet height position detection sensor 6 is turned ON (A-4). At that time, the CPU 31 controls the solenoid 34 to move the stamp 38 of the sheet bundle side surface marking unit 7, and a mark is put on the boundary between the sheet bundles 10 (A-5).

If the photo-interrupter 37 of the sheet storage case full-load detection sensor 16 is OFF at that time (A-6), the CPU 31 again controls the motor 32 to start lowering the stack tray 5, and the series of processing is repeated (A-1 to A-6).

If the photo-interrupter 37 of the sheet storage case full-load detection sensor 16 is ON (A-6), the processing is completed, and the system waits until the sheet storage case 1 is closed by the operator. When the operator stops the sheet-adding operation in a state where the photo-interrupter 37 of the sheet storage case full-load detection sensor 16 is OFF and the sheet storage case 1 is closed also, the processing is completed as it is.

<When Sheets are Fed>

When it is required to send sheets from the image forming apparatus connected to the feeding apparatus of the present invention, the image pickup element 36 of the mark detection sensor 9 detects whether there is a sheet boundary mark 8 on a side surface of a sheet to be fed.

If there is a sheet boundary mark 8, sheet boundary mark detection sensor 9 is turned ON (B-1). With this, the CPU 31 drives the motor 32, rocks the arm member 13, and increases the pressing force of the retard roller 23 with respect to the feed roller 22 in accordance with the feeding operation of the sheet boundary (B-2).

A sheet is fed depending upon the changed feeding condition (B-3). When there is no sheet boundary mark 8, the sheet is fed under normal feeding condition (B-3). The processing is completed by the feeding of the sheets. Since a friction coefficient of a sheet that is near the sheet bundle boundary is increased, the overlapping-feeding is prone to be generated.

In the case of sheets having high smoothness such as art paper or coated paper, since the sheets are crushed near the sheet bundle boundary and air is less prone to enter in between sheets, the adsorption force between sheets is increased, and the overlapping-feeding is prone to be generated near the sheet bundle boundary. Therefore, in this embodiment, in order to prevent the overlapping-feeding, the sheet feeding condition at the sheet boundary is changed such that the pressing force on the feed roller 22 by the retard roller 23 is increased.

An amount of change of the feeding condition of the sheet described above (i.e., the amount of increase of pressing forces of the feed roller 22 and the retard roller 23) is previously obtained as data from an experiment in accordance with kinds of sheets. The data is stored in the control apparatus 30 and the data is appropriately output.

The feeding conditions of the sheets are previously obtained as data from an experiment of surrounding temperature and moisture where the image forming apparatus is used, and the data may be output and used from the control apparatus 30 based on the detection of an environment sensor provided in the image forming apparatus. The feeding condition of the sheets may be changed by a constant amount irrespective of the kinds of sheets and environment where the apparatus is used.

Second Embodiment

Figure 7:
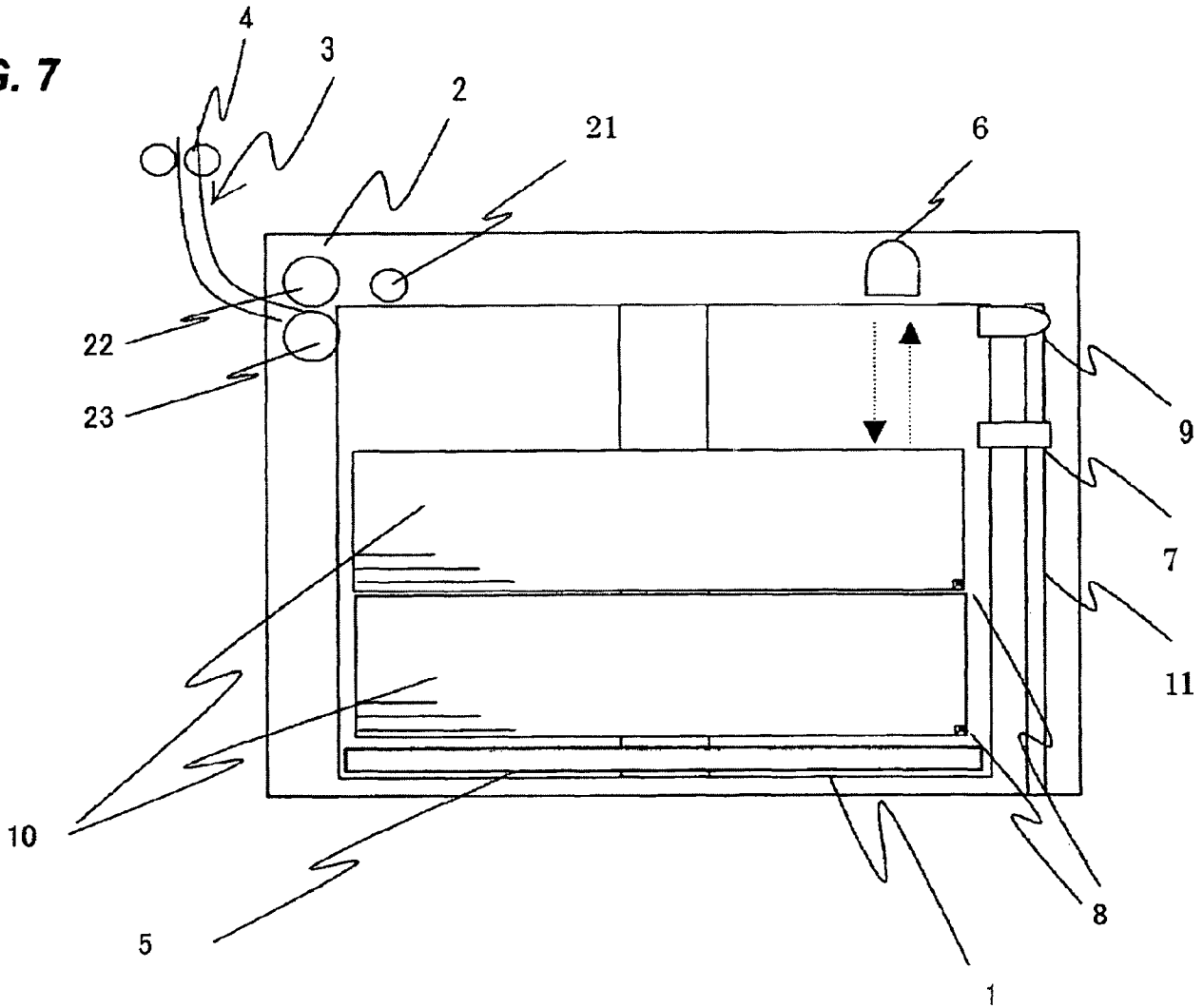
FIG. 7 is a schematic diagram illustrating a structure of a sheet feeding apparatus according to a second embodiment of the invention.

FIG. 7 schematically illustrates a structure of a sheet feeding apparatus according to a second embodiment. In the second embodiment, the position of the sheet bundle side surface marking unit 7 which is fixed in the first embodiment is provided such that the unit 7 can be lifted and lowered along the stacking direction of sheets. Portions of the second embodiment which are different from the first embodiment will be described in detail, and description of the same structure as that of the first embodiment will be omitted.

If the sheet storage case 1 is opened to add sheets, the stack tray 5 is lowered by the motor 32 to a lower limit of the sheet storage case 1 near a lower limit position detection sensor (not illustrated) and stops. The sheet bundle side surface marking unit 7 of this embodiment can be lifted and lowered by lifting/lowering unit 11. The lifting/lowering unit 11 includes a pulley, a wire and a motor, where the wire is wound or rewound by rotation of the motor, thereby lifting and lowering the stack tray 5. A sheet height position detection sensor 6, as a sheet height detecting unit which detects a height of the uppermost surface of the sheet 12, is disposed above the apparatus.

The sheet height position detection sensor 6 detects an uppermost sheet position of a sheet 12 stacked on the stack tray 5 which is lowered to the lower limit position, i.e., a position where a bottom surface of the sheet bundle 10 to be added is placed, and the sheet bundle side surface marking unit 7 moves to the position. With this, a height direction position of the lower end of the added sheet bundle 10 matches with a height direction position of the marking unit 7, and the mark 8 can be put on the boundary between the sheet bundles 10.

When a sheet bundle 10 is further added, the sheet height position detection sensor 6 again detects the height of the uppermost surface of the sheet bundle 10 which is stacked on the stack tray 5, and the sheet bundle side surface marking unit 7 is moved based on the detection. The mark 8 is put on the boundary between the already stacked sheet bundle 10 and the newly added sheet bundle 10 By repeating this operation sequentially, it is possible to put the mark 8 on the boundary between the added sheet bundles 10.

An optical distance sensor is used as the sheet height position detection sensor 6 of the embodiment. Time elapsed until emitted light is reflected by an upper surface of the sheet bundle 10 is measured, and the position of the uppermost sheet is measured. The feeding control of sheets 12 after a mark is put on the boundary between sheet bundles 10 is the same as that of the first embodiment and thus, description thereof will be omitted.

Third Embodiment

In a third embodiment, the sheet bundle side surface marking unit 7 is not used as the sheet bundle boundary detecting unit. Instead, the position of the sheet boundary is previously stored, and whenever sheet 12 is fed, the number of sheets is counted and the sheet boundary is detected. Portions of the third embodiment which are different from the first embodiment will be described in detail, and description of the same structure as that of the first embodiment will be omitted.

Figure 8:
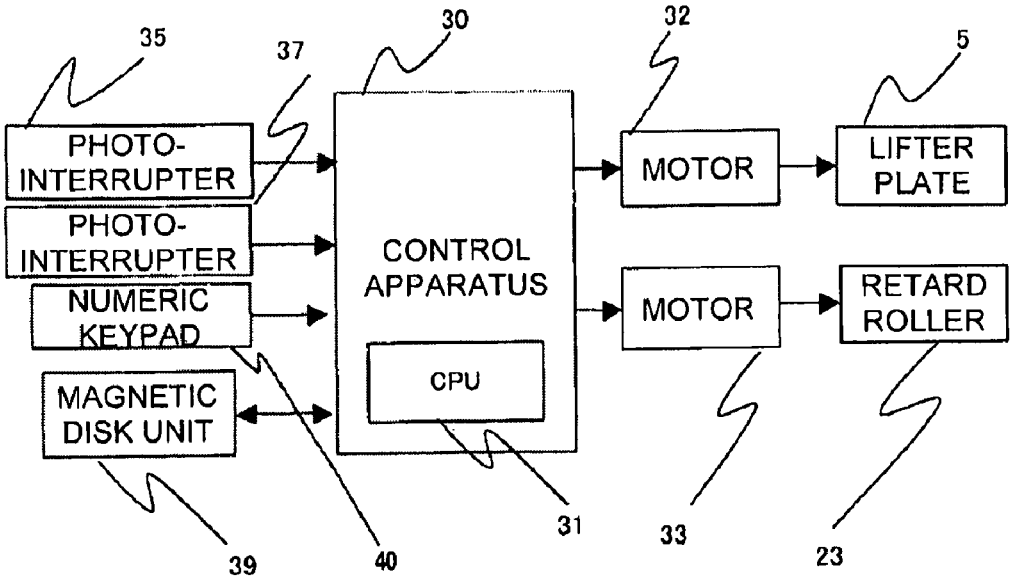
FIG. 8 is a block diagram for describing control of a sheet feeding apparatus according to a third embodiment of the invention.

In FIG. 8, a control apparatus 30 includes a CPU 31. Photo-interrupters 35 and 37 and a numeric keypad 40 are connected to the control apparatus 30, and signals from the photo-interrupters 35 and 37 and the numeric keypad 40 are input to the control apparatus 30. The control apparatus 30 and the magnetic disk unit 39 are connected to each other so that information can be exchanged therebetween. Motors 32 and 33 are connected to the control apparatus 30, and the motors 32 and 33 are controlled based on information from the photo-interrupters 35 and 37, the numeric keypad 40 and the magnetic disk unit 39. As illustrated in FIG. 3 in the first embodiment, the motor 32 moves the stack tray 5, and the motor 33 moves the retard roller 23 through the arm member 13.

The numeric keypad 40 constitutes an adding number input portion through which the number of sheets to be added is input, and an operator is made to input the number of sheets of added sheet bundles 10. The magnetic disk unit 39 constitutes a number of added sheets storing portion, and the number of added sheets which is input by the operator, and the number of sheets existing on the sheet boundary which is calculated from the number of added sheets are stored in the magnetic disk unit 39.

Figure 9:
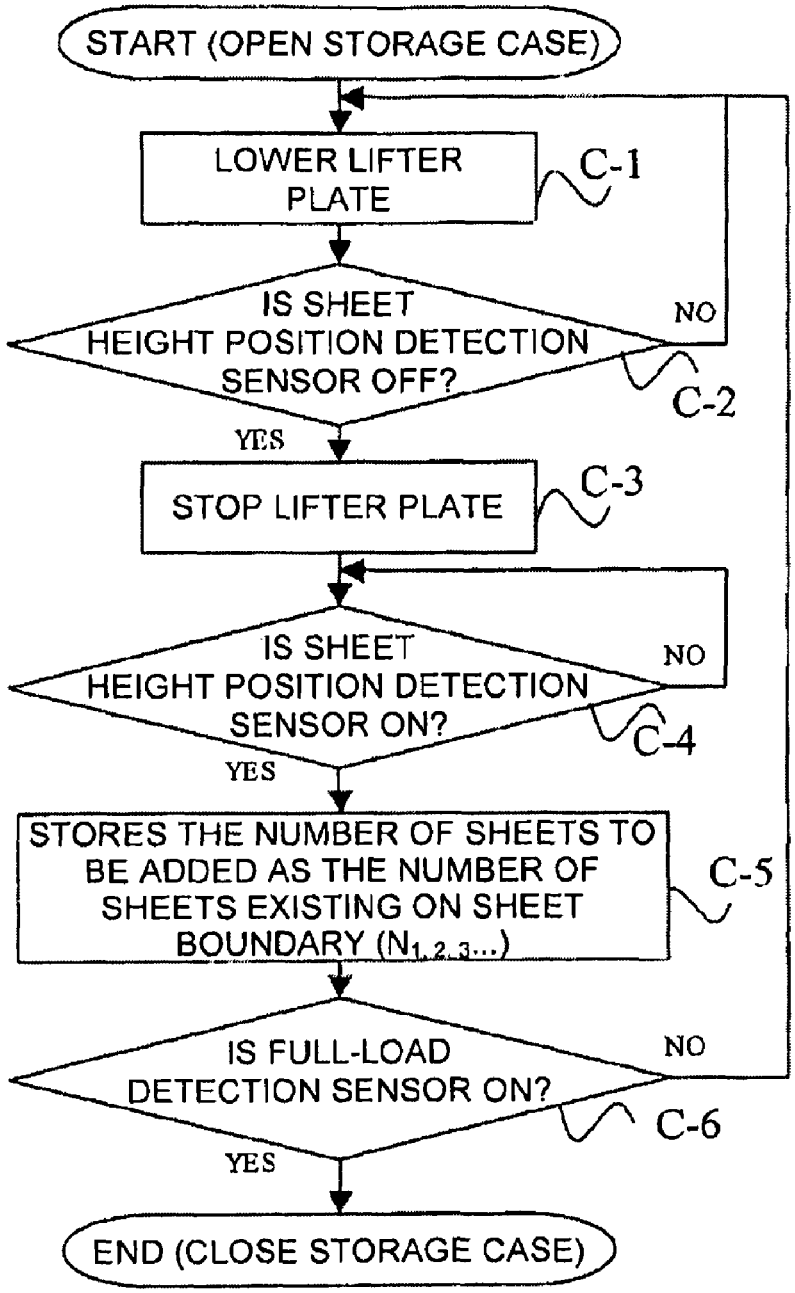
FIG. 9 is a flowchart for describing control of the sheet feeding apparatus illustrated in FIG. 8 when sheets are added.
Figure 10:
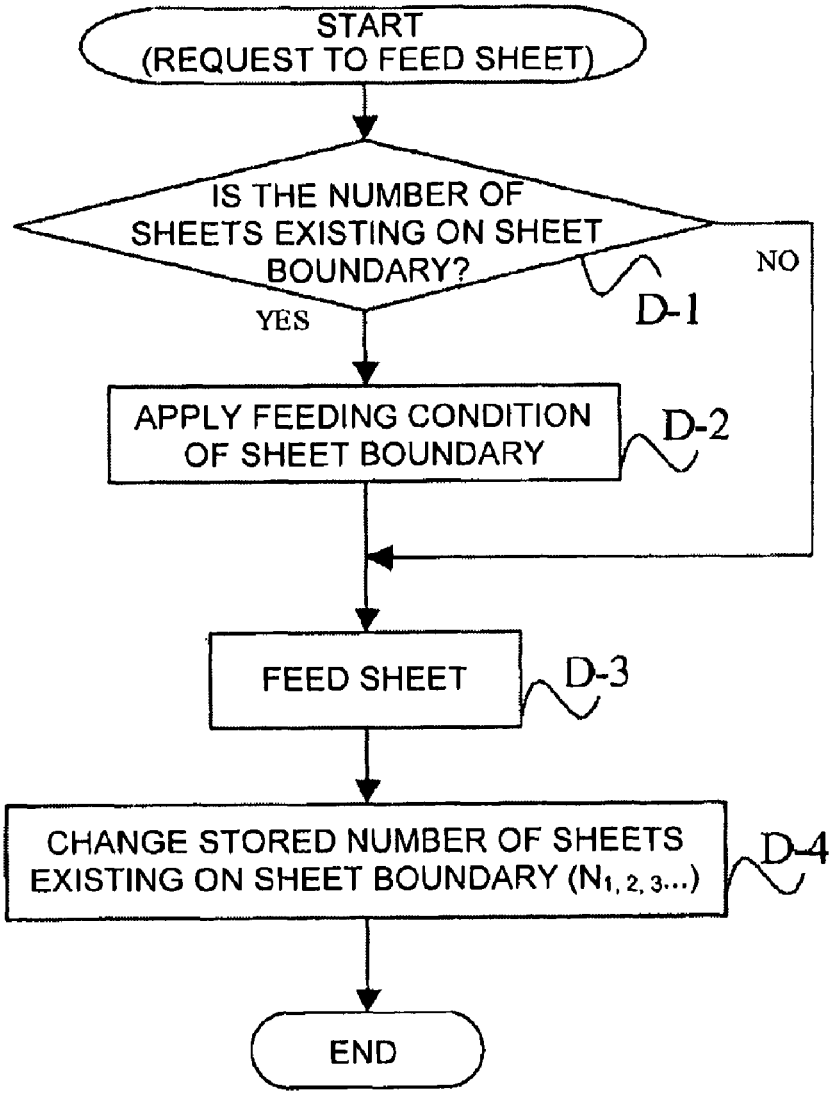
FIG. 10 is a flowchart for describing operation of the sheet feeding apparatus illustrated in FIG. 8 when sheets are fed.

Control of the control apparatus 30 will be described using flowcharts illustrated in FIGS. 9 and 10 The description is divided into a case when sheets are added and a case when sheets are fed.

<When Sheets are Added>

If an operator pulls out the sheet storage case 1, it is detected that the sheet storage case 1 is pulled out by detection unit (not illustrated), and the CPU 31 controls the motor 32 to start lowering the stack tray 5 (C-1). If the sheet height position is moved to a predetermined position which is set lower than the ceiling surface of the sheet storage case 1 by about 50 to 100 mm, the photo-interrupter 35 of the sheet height position detection sensor 6 is turned OFF (C-2). The CPU 31 controls the motor 32 based on a signal from the photo-interrupter 35, stops the stack tray 5 and waits until a new sheet bundle 10 is added by an operator (C-3).

If the new sheet bundle 10 is added by the operator, since the height position of the sheet 12 is lifted, the photo-interrupter 35 of the sheet height position detection sensor 6 is turned ON (C-4).

At that time, an operator is guided to input the number of added sheets 12 by means of the numeric keypad 40 using sound or display on a display unit. The number of added sheets 12 which is input by the operator is stored in the magnetic disk unit 39 as N1, N2, N3 . . . up to the boundary of the sheets 12 (boundary of the added portion) (C-5).

That is, the number of sheets 12 existing on the boundary is stored for every sheet bundle 10 such that a first sheet bundle is N1, a second sheet bundle is N2, . . . .

If the photo-interrupter 37 of the sheet storage case full-load detection sensor 16 is OFF (C-6) when a sheet bundle 10 is added, the CPU 31 again controls the motor 32 to start lowering the stack tray 5, and the series of processing is repeated (C-1 to C-6). If the photo-interrupter 37 of the sheet storage case full-load detection sensor 16 is ON (C-6), the processing is completed, and the system waits until the sheet storage case 1 is closed by the operator.

When the operator stops the sheet-adding operation in a state where the photo-interrupter 37 of the sheet storage case full-load detection sensor 16 is OFF and the sheet storage case 1 is closed, the processing is completed as it is.

<When Sheets are Fed>

If it is required to feed a sheet from the image forming apparatus or the like, the control apparatus 30 pulls out the number of sheets existing on the boundary which is stored in the magnetic disk unit 39. The control apparatus 30 compares the number of sheets 12 to be fed and the number of sheets existing on the boundary with each other, and determines whether this is the boundary of the sheets 12 (D-1).

When it is determined that the number of fed sheets 12 becomes close to the number of sheets existing on the boundary of the sheets 12, the motor 32 is driven, and the pressing force of the retard roller 23 is changed in accordance with the feeding operation of the boundary of the sheets through the arm member 13 (D-2). The sheets 12 are fed under the changed feeding condition (D-3). In this case, the feeding condition is changed when the number of sheets 12 to be fed is smaller than the number of sheets existing on the boundary by a predetermined number (e.g., 5 to 10 sheets), and when the number of sheets 12 to be fed exceeds the number of sheets existing on the boundary by a predetermined number (e.g., 5 to 10 sheets), the feeding condition is returned to the original condition.

When it is determined that the number is not the number of sheets 12 existing on the boundary, sheets 12 are fed under the normal feeding condition (D-3). After the sheets 12 are fed, the number of sheets existing on the boundary which is stored in the magnetic disk unit 39 is reduced by the number of fed sheets. When the sheet 12 comes to the boundary, the number is changed to the number of sheets Nnext existing on the next boundary (D-4). The number is changed to the number of sheets 12 to the boundary and then, the processing is completed.

In this embodiment, the boundary of sheets 12 added to the sheet storage case 1 is detected, and the feeding condition of the sheet feeding unit 2 is changed based on the detection result of the sheet bundle boundary detecting unit. With this, the overlapping-feeding and the miss-feeding at the boundary of sheets 12 are reliably prevented. Thus, the sheets 12 are efficiently fed, and the productivity of the image forming apparatus can be maintained.

The present invention is not limited to the above-described embodiments. For example, since overlapping-feeding is prone to be generated at the boundary of sheet bundles, the pressing force of the feed roller 22 and the retard roller 23 is increased, but in a sheet feeding apparatus using another sheet separating mechanism, the feeding condition may be changed so that the overlapping-feeding is prevented by respective sheet separating mechanisms. For example, in a mechanism using a separation pad, a pressing force of pressing the separation pad against the feeding roller may be increased. In an air feeding mechanism in which air is sprayed on an end of a sheet to adsorb the uppermost sheet 12 on an adsorbing conveying belt, air which is sprayed on the sheet 12 may be increased.

Although the pressing force of the feed roller 22 and the retard roller 23 is changed to prevent the overlapping-feeding in the embodiment, the abutment pressure between the pickup roller 21 and a sheet may be weakened without changing the pressing force, and a sending-out force of a sheet may be reduced to prevent the overlapping-feeding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus which forms an image on a sheet by an image forming unit comprising:

a sheet storage portion in which sheets are stored;

a sheet feeding unit which feeds the sheet stored in the sheet storage portion;

a sheet bundle boundary detecting unit which detects boundaries between sheet bundles added in the sheet storage portion; and a control unit which determines the boundary of the sheet bundle based on a detection result of the sheet bundle boundary detecting unit and which changes a feeding condition of the sheet feeding unit.

2. The image forming apparatus according to claim 1, wherein the sheet bundle boundary detecting unit includes a marking unit which puts a mark on a side surface on the boundary between the sheet bundle stored in the sheet storage portion and an added sheet bundle, and a mark detecting unit which detects the mark put on the side surface of the sheet bundle, and the control unit determines the boundary between the sheet bundles based on information from the mark detecting unit, and changes the feeding condition of the sheet feeding unit.

3. The image forming apparatus according to claim 2, wherein a stack stray which can be lifted and lowered is disposed in the sheet storage portion, the stack tray is controlled such that a position of the uppermost sheet stacked when sheets are added becomes a predetermined position, the marking unit is disposed at the same height as the predetermined position, and when the position of the uppermost sheet stacked on the stack tray is lowered to the predetermined position and sheets are added, the marking unit puts a mark on the side surface of the sheet bundle.

4. The image forming apparatus according to claim 2, wherein a stack tray which can be lifted and lowered is disposed in the sheet storage portion, the stack tray being controlled such that the stack tray moves to a lower limit position when sheets are added, the marking unit is provided such that the marking unit moves in a lifting and lowering direction of the stack tray, a sheet height detecting unit which detects a height of the uppermost sheet stacked on the stack tray is provided, a stack tray is moved to the lower limit position when sheets are added, the sheet height detecting unit detects a height of an upper surface of a sheet stacked on the stack tray, and the marking unit is moved to a position of the uppermost sheet bundle, based on detection of the sheet height detecting unit, to put a mark on a side surface of the sheet bundle.

5. The image forming apparatus according to claim 1, wherein the sheet bundle boundary detecting unit includes an adding number input portion through which the number of sheets in a bundle to be added is input, and a number of added sheets storing portion which stores the number of sheets which are input through the adding number input portion per sheet bundle, and which stores the number of sheets to be fed, and the control unit determines a boundary between the sheet bundles based on information from the number of added sheets storing portion, and changes the feeding condition of the sheet feeding unit.

6. The image forming apparatus according to claim 1, wherein the sheet feeding unit includes a feed roller which feeds a sheet and a sheet separating mechanism having a retard roller capable of rotating in a direction in which a sheet is returned, and wherein a force bringing the feed roller and the retard roller into contact under pressure is increased based on a detection result of the sheet bundle boundary detecting unit.

* * * * *